US005956003A

United States Patent [19]

Fisher

[11] Patent Number: 5,956,003

[45] Date of Patent: Sep. 21, 1999

[54] FLAT PANEL DISPLAY WITH ARRAY OF MICROMACHINED INCANDESCENT LAMPS

[75] Inventor: Michael Aaron Fisher, White Plains, N.Y.

[73] Assignee: Hypres, Inc., Elmsford, N.Y.

[21] Appl. No.: 08/685,516

[22] Filed: Jul. 24, 1996

[51] Int. Cl.[6] ..... G09G 3/24; H01J 9/00

[52] U.S. Cl. ..... 345/73; 445/24

[58] Field of Search ..... 345/73, 30, 55, 345/84; 313/522, 579, 578, 580, 495, 315; 445/24, 25, 27, 46, 48

[56] References Cited

U.S. PATENT DOCUMENTS

| | | | |
|---|---|---|---|
| 3,715,785 | 2/1973 | Brown et al. | 445/24 |
| 3,788,721 | 1/1974 | Vause | 445/27 |
| 4,063,234 | 12/1977 | Arn et al. | 345/73 |
| 4,480,212 | 10/1984 | Monahan et al. | 315/71 |
| 4,771,278 | 9/1988 | Pooley | 345/73 |
| 4,777,404 | 10/1988 | Kiesel et al. | 313/579 |
| 4,894,645 | 1/1990 | Odlen | 345/73 |
| 5,285,131 | 2/1994 | Muller et al. | 313/578 |
| 5,644,676 | 7/1997 | Blomberg et al. | 313/522 |
| 5,712,650 | 1/1998 | Barlow | 345/73 |
| 5,767,818 | 6/1998 | Nishida | 345/73 |

*Primary Examiner*—Jeffery Brier
*Assistant Examiner*—Paul A. Bell
*Attorney, Agent, or Firm*—Henry I. Schanzer

[57] ABSTRACT

A flat panel display assembly includes an array of micromachined incandescent lamps. According to one aspect of the invention, the array of lamps is placed on a gas filled enclosure to enable the filaments to be operated at higher temperatures with extended lifetimes. According to another aspect of the invention, each lamp (or groups of lamps) may be formed in its own gas filled pocket. In some embodiments, a diode is connected in series with each lamp filament. This arrangement enables the array to be operated such that power is applied to the row (column) at a time and to selected columns. The effective brightness of each lamp may be controlled by determining the length of time each lamp is turned-on.

29 Claims, 17 Drawing Sheets

FLAT PANEL DISPLAY WITH ARRAY OF MICROMACHINED INCANDESCENT LAMPS

BACKGROUND OF THE INVENTION

This invention relates to microfabricated incandescent lamps and, in particular, to methods for fabricating arrays of microminiature incandescent lamps, to the arrays so fabricated and to circuitry for operating arrays of microminiature incandescent lamps.

It is desirable to use microminiature incandescent lamps to form an array of micromachined incandescent filaments for use in the manufacture of flat panel display assemblies. In many military and civilian applications (e.g., portable computers, automobiles and aircrafts) a need exists for a flat, inexpensive, lightweight electronic display for images and digital information. Cathode ray tubes (CRTS) are too large and heavy for use in these environments. Known conventional flat panel alternatives have significant drawbacks. Liquid crystal displays (LCDs) suffer from slow response, narrow viewing angle, difficult viewing without backlighting, and extremely high cost. When backlighting is used with an LCD, the backlit LCDs waste most of the optical power from their lamps because their operation is based on blocking the light of the pixels that are not required to be lit. Electroluminescent displays are inefficient. Plasma displays require high voltage circuitry and are inefficient. Light emitting diodes (LEDs) have not been produced with blue color at a reasonable cost and efficiency. Also, the best blue light producing LEDs currently can not be fabricated on the same substrate material as the red and green LEDs. This makes the process for manufacturing an array of red green and blue LEDs difficult and costly.

Therefore, there is a need for a technology which can give high brightness over the full color spectrum, which has a relatively fast response, which can operate at moderate voltage levels, and which has high efficiency, all at a low production cost. Applicant recognized that microminiature incandescent lamps is such a technology and that it may be used to produce display panels which can replace CRTs and known conventional flat-panels in many applications.

SUMMARY OF THE INVENTION

One aspect of Applicant's invention resides in the fabrication of an array of microminiature incandescent lamps within a sealable enclosure and with the addition of a reactive gas, such as halogen based compounds, or an inert gas, such as argon, helium, neon or any combination thereof, within the enclosure. The addition of the gas enables the filaments of the lamps to be operated at increased temperatures resulting in greater efficiency and prolonged filament lifetime. The microminiature incandescent lamps used to practice the invention are formed using "micromachined" or "micromachining" processes; where the terms micromachined or micromachning, as used herein and in the appended claims, refer to any three dimensional (3D) structure produced by chemically reactive lithographic processes.

Another aspect of the invention resides in a filament design which reduces the mechanically distorting effects of residual stress in the filaments and, therefore, increase the effective manufacturing yield (i.e., the percentage of working devices emerging form the manufacturing process). A filament, in accordance with the invention, is supported at all critical stress points (i.e., every bend) to prevent warping and breakage from the high operating temperature.

Still another aspect of the invention resides in the fabrication of an array of incandescent lamps with each lamp of the array being enclosed within its own envelope containing a gas which enables the lamp filament to be operated at increased temperature.

According to still another aspect of the invention, arrays of incandescent lamps may be formed in a matrix array of rows and columns with a row conductor per row of lamps and a column conductor per column of lamps, with the lamps of a row sharing the same row conductor and the lamps of a column sharing the same column conductor. In a preferred embodiment a diode is formed in series with each lamp to prevent "sneak" paths which would cause spurious lighting of unselected lamps (i.e., pixels). A lamp is energized and emits light when a voltage differential exists between its row and column conductor. The circuitry to supply power to selected incandescent lamps and to control their turn-on and turn-off may be located along the edges of a panel containing an array of incandescent lamps and may be arranged to activate one row (or column) of incandescent lamps at a time, with only selected lamps being energized.

Also, the brightness of the lamps may be controlled by pulse-width modulating (PWM) techniques. For example, a voltage of fixed amplitude is applied to selected lamps for different lengths (or periods) of time to control the brightness of the selected lamps. Alternatively, varying numbers of fixed amplitude, fixed pulse width, pulses may be applied to the lamps to control their brightness.

BRIEF DESCRIPTION OF THE DRAWINGS

In the accompanying drawings like reference characters denote like components.

DETAILED DESCRIPTION OF THE INVENTION

Figure 1A:
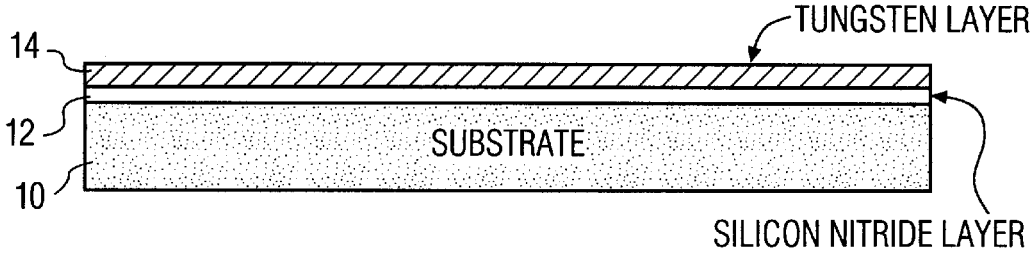
FIGS. 1A, 1B, 1C and 1D are cross section diagrams illustrating the fabrication of micromachined filaments, in accordance with the invention.

FIG. 1A is a cross-section diagram showing the deposition of a silicon nitride layer 12 on a substrate 10 and the deposition of a layer 14 of tungsten (W) over the silicon nitride layer 12. The substrate 10 may be silicon, glass, or any other heat resistant electrical insulator. The thickness of the substrate 10 may vary over a wide range, for example, from 0.02 mm to more than 25 mm with the factors considered in setting the thickness of the substrate 10 being mechanical strength and weight. The thickness of the silicon nitride layer 12 may range from nothing (i.e., no nitride layer) to 10 micrometers, or more, and the factors considered in setting its thickness are internal mechanical stress and mechanical strength. The thickness of the tungsten layer 14 may have a broad range (e.g., 1 nanometer to 20 microns) with the factors considered in setting its thickness being internal mechanical strength, thermal conductance, electrical resistance and heat capacity (which affects switching times).

The surface area of the substrate 10 may vary greatly; it may have a length ranging from 0.003 meters to 30 meters and a width also ranging from 0.003 m to 30 m. Limitations on the minimum length and width are the smallest dimensions that can be seen by a viewer, with the limitations on the maximum length and width being manufacturing capability and cost. A typical diagonal dimension for the display of a portable television would typically range from 25 mm to 200 mm. A typical diagonal dimension for a portable "laptop" computer display would typically be 100 mm to 400 mm. A typical diagonal dimension for a desktop computer display would range from 300 mm to 550 mm, or more. A typical diagonal dimension for a home television display would typically range from 75 mm to 3000 mm. A large display such as that used in a stadium or sports arena may be composed of several, independently controlled sections, each covering a fraction of the total area of the display.

The area occupied by each lamp, light source or picture element (i.e., "pixel") generally depends on the total number of pixels required for the display. For example, a 640 mm by 480 mm display with 640 by 480 pixels of resolution may have a pixel size, or lamp size, ranging from 0.005 mm to 1 mm in both the vertical and horizontal directions.

The filaments at each lamp location may be fabricated with either a back-etching process or a surface-micromachining process.

Figure 1B:
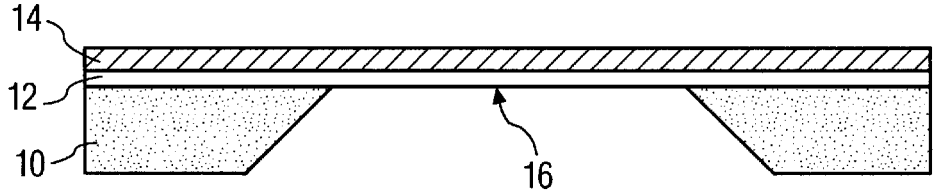
Figure 1C:
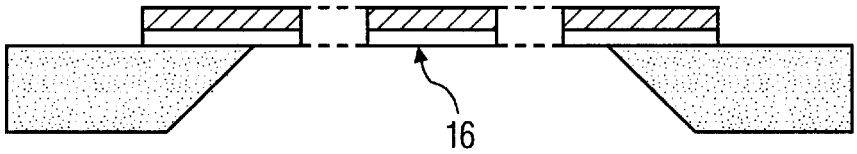
Figure 1D:
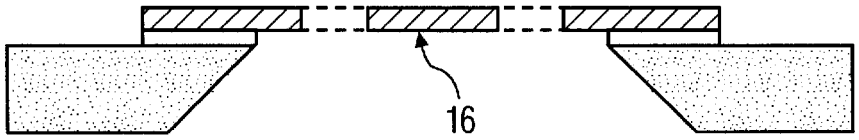

FIGS. 1B, 1C, and 1D illustrate a back-etching process. FIG. 1B is a cross-section showing the back etching of the substrate 10 to expose the underside of the silicon nitride layer 12 at selected locations 16. Each location 16 defines the site of a light source.

FIG. 1C illustrates the patterning of the tungsten layer 14 to form a light source with a filament having a desired shape and the corresponding patterning of the underlying silicon nitride layer 12.

FIG. 1D illustrates the removal of the silicon nitride layer underlying the tungsten layer at a location 16, leaving the "patterned" tungsten layer fully exposed. The silicon nitride layer 12 may be removed by etching it away or by applying power to the filament and evaporating the silicon nitride, a process which is referred to herein as "burn-in".

Thus, in FIGS. 1A, 1B, 1C, 1D, a back etching process is used to remove the silicon from beneath a tungsten layer. This process is very versatile and may be used to define many different filament shapes.

The filaments may also be fabricated with a surface-micromachining process as illustrated in FIGS. 2A, 2B, 2C and 2D.

Figure 2A:
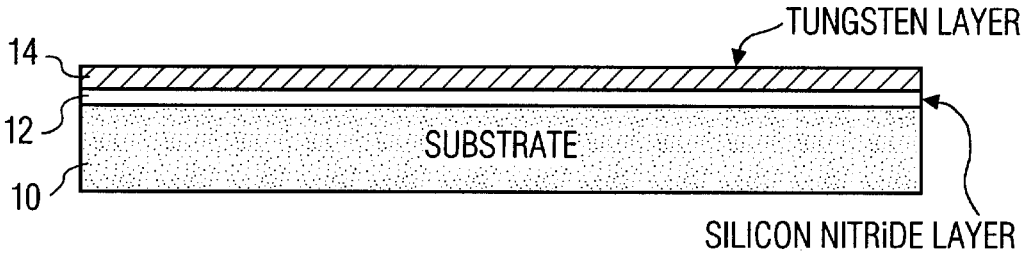
FIGS. 2A, 2B, 2C and 2D are cross section diagrams illustrating the fabrication of surface micromachined filaments, in accordance with the invention.

FIG. 2A is similar to FIG. 1A and illustrates the basic structure comprised of an electrical insulator substrate 10 on which is deposited a nitride layer 12 over which is deposited a tungsten layer 14.

Figure 2B:
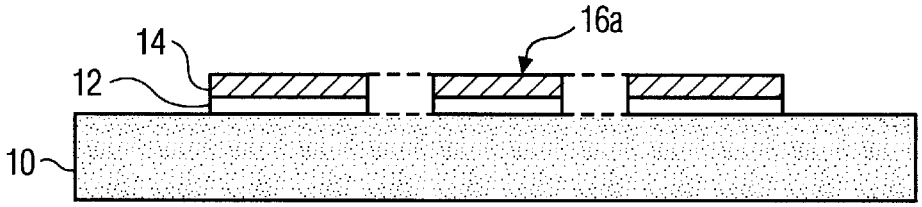

FIG. 2B is a cross-section showing patterning of the tungsten layer 14 and the underlying silicon nitride layer 12 at selected locations 16*a* to form a light source filament having the desired shape. This patterning step also exposes the top surface of the insulating substrate 10 at locations 16*a* corresponding to the openings in the tungsten and silicon nitride films. Each location 16*a* defines the site of a light source.

Figure 2C:
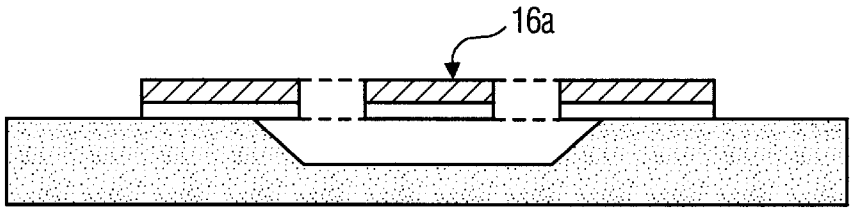

FIG. 2C illustrates the surface micromachining and undercutting of the substrate 10 to create an empty pocket beneath the location 16*a*, which defines the site of the light source.

Figure 2D:
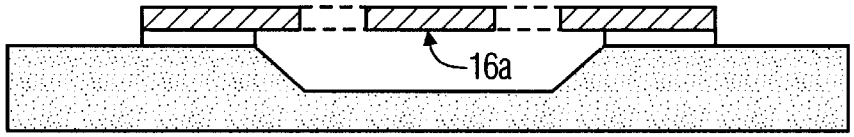

FIG. 2D illustrates the removal of the silicon nitride layer underlying the tungsten layer at location 16*a*, leaving the "patterned" tungsten layer fully exposed. The silicon nitride layer 12 may be removed from under the filament area by etching it away or by the "burn-in" process described above. Thus, the filament fabricated with a surface micromachining process (as shown in FIGS. 2A–2D), leaves most of the substrate intact.

Figure 3A:
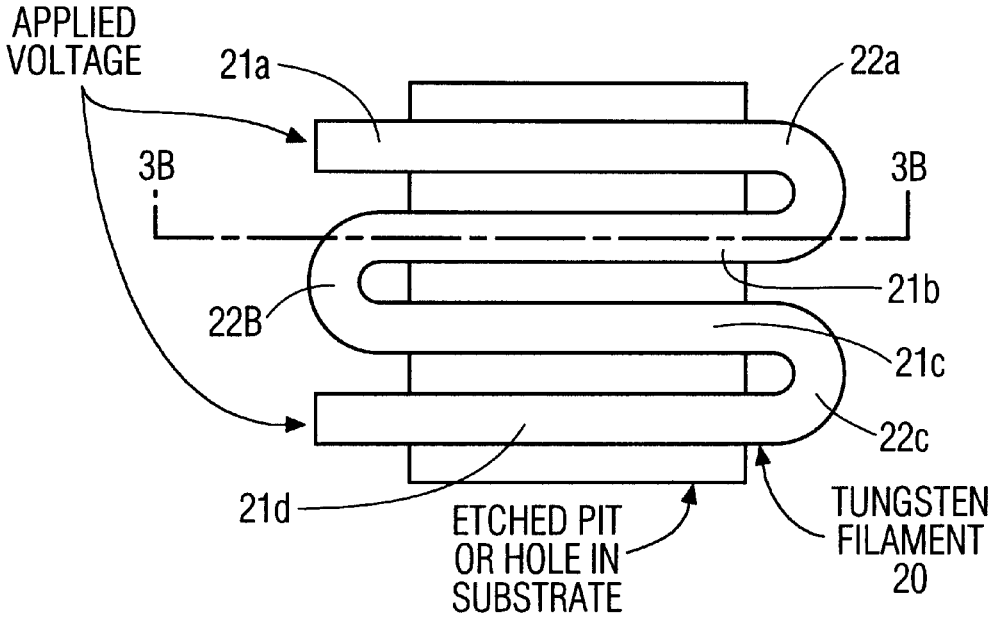
FIG. 3A is a top view of a filament formed in accordance with the invention.

FIG. 3A is a top view of a micromachined incandescent tungsten filament fabricated in accordance with the invention. The shape of the filament is described to herein as a "meander" or "serpentine" line since it goes back and forth. As shown in FIG. 3, the filament 20 is constructed entirely of a single, patterned, tungsten thin film deposited on a silicon wafer. The tungsten film is formed in a serpentine (meander) line fashion to obtain a large resistance within a compact geometric area. The amount and quality of light produced by the filament is a function of the temperature of the filament which in turn is a function of the current through the filament and the value of resistance of the filament. The amount of light is also a function of the total exposed surface area of the hot filament. The insulating substrate beneath the straight sections of the filament is etched away to leave the filament 20 suspended. This is necessary to minimize the amount of heat lost by direct thermal conduction into the substrate.

Figure 3B:
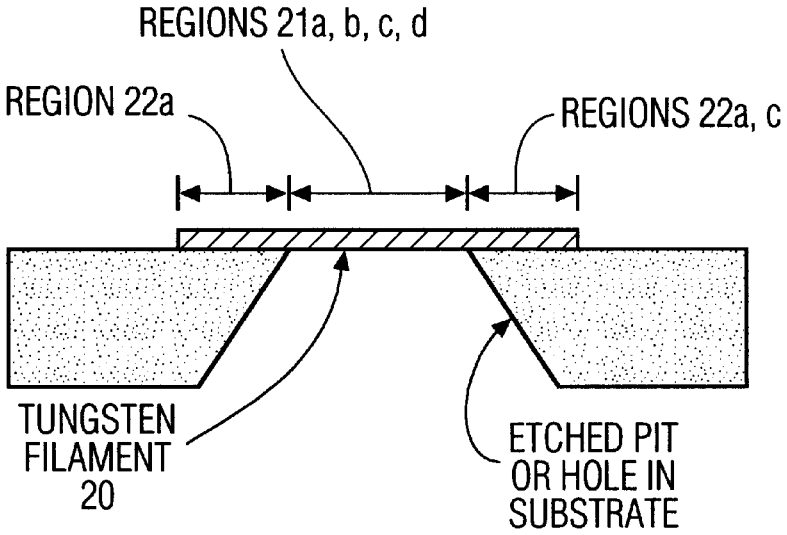
FIG. 3B is a cross section of FIG. 3A along line 3B.

In FIG. 3A, the filament 20 is shown to be composed of straight sections 21*a*, 21*b*, 21*c*, 21*d* which are actually free standing (unsupported) and of connective curved sections 22*a*, 22*b*, 22*c* which are supported by the substrate 10. Such a geometry is less sensitive to stress warping than a completely suspended meander line. FIG. 3B shows a cross section of the filament along line 3B of FIG. 3A and demonstrates the substrate supporting the curved sections of the filament.

Figure 4:
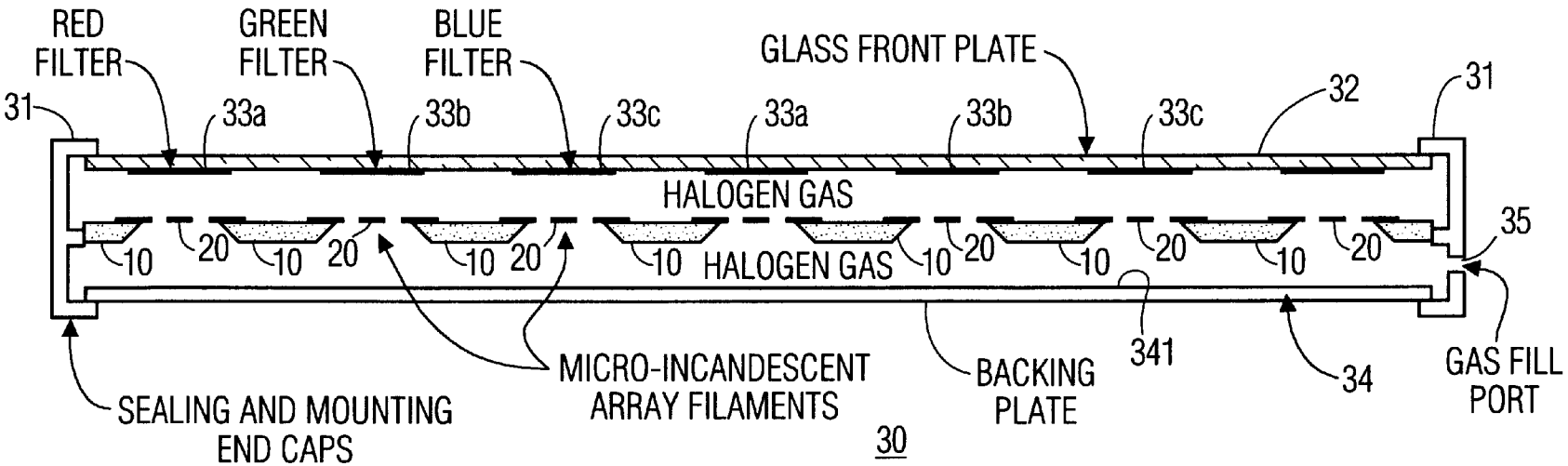
FIG. 4 is a cross section diagram of a flat panel assembly formed in accordance with the invention.

FIG. 4 is a cross section of a flat panel display assembly 30 which includes an array of incandescent lamps formed using a back etched processing technique. In FIG. 4, there is shown a frame or enclosure 31 to hold a front glass plate 32, a silicon substrate 10 on which is formed an array of "microminiature" incandescent elements, and a back plate 34. The flat panel assembly 30 includes one, or more, port holes 35 for injecting an inert gas or a reactive gas, as discussed below, into the assembly and then sealing the port hole 35. The flat panel assembly 30 includes a glass (or any suitable transparent material) front panel 32 on which are mounted different colored filters (e.g., 33*a*, 33*b*, 33*c*). The different colored filters may be fabricated with any standard lithographic, silk screening or printed technique. A red filter 33*a*, a green filter 33*b* and a blue filter 33*c* are shown for enabling the production of various color combinations. The substrate 10, on which is formed an array of incandescent lamps, is mounted on frame 31 and is spaced from the glass plate 32 to allow the flow of gas therebetween. The back plate 34 is shown spaced from the underside of the substrate 10, with the space being filled with a gas (e.g., halogen). Alternatively, the back plate may be mounted flush with the underside of the substrate 10. The surface 341 of the back plate contacting (facing) the substrate 10 may be designed to be highly reflective to reflect light produced by the filament and, at the same time, to conduct heat. The back plate 34 may be of any suitable material, including copper, aluminum, steel, plastic or glass. The basic plate surface 341 may be plated or coated with aluminum, silver, or any other reflective material.

Figure 5:
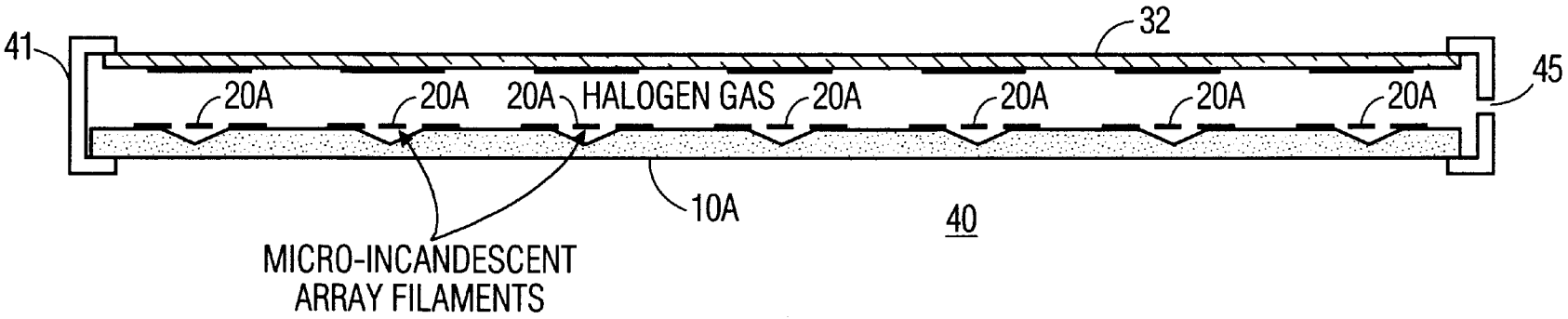
FIG. 5 is a cross section diagram of another flat panel array in accordance with the invention.

An assembly of incandescent lamps formed using a surface micromachining technique may be arranged to form a flat panel display assembly 40, as shown in FIG. 5. The substrate 10*a* is undercut to form a pit at each lamp location with each lamp filament 20*a* formed using the surface micromachining process described for FIGS. 2A–2D. The array of lamp filaments 20*a* formed on substrate assembly 10*a* is mounted in the rear of a frame or enclosure 41. A transparent plate 32 is mounted in the front of the assembly 41 spaced apart from the substrate 10*a* with a gas of the types discussed below being used to fill the space between the transparent front plate 32 and the substrate assembly 10*a*. The gas is introduced via a port hole 45 which is sealed after the gas has filled the space between the front plate and the substrate assembly 10*a*.

In the manufacture of the lamp assemblies shown in FIGS. 4 and 5, three independently controlled lamps may be clustered at each lamp or pixel location to provide red, blue, and green or a combination of two or three thereof. The transparent front panel 32 of the assembly may be arranged to hold an array of red, blue, and green colored optical filters, one colored filter for each lamp to produce a full color display.

As noted above, an inert gas or a reactive gas may be used to fill the lamp enclosures. For example, an inert gas, such as argon, helium, or neon, or any other inert gas, or any combination thereof, may be used to fill the enclosure containing the lamps. The pressure of the gas would be above the vapor pressure of tungsten at the temperature of operation of the filaments. This added pressure dramatically reduces the rate at which tungsten evaporates from the hot filaments 20 and 20*a* and correspondingly prolongs the life of each filament. This technique uses the combination of microfabricated incandescent technology and inert gas technology.

Alternatively, a reactive gas which may be halogen gas, such as chlorine, fluorine, bromine or iodine, or a compound, such as methylene bromide, containing a halogen, may be used to fill the enclosure containing the lamps. These halogen gases and compounds form stable, tungsten halide compounds when they react with tungsten at temperatures well below that of the filament. The tungsten halide compounds decompose at elevated temperatures, such as those present when the filaments are energized. As the filament material evaporates, the evaporated tungsten cools and reacts with the surrounding halogen gas to form a stable tungsten halide compound such as tungsten bromide. The tungsten halide compound circulates throughout the enclosure and decomposes into tungsten and a halogen when it touches the hot filament, depositing the tungsten back onto the filament. In particular, narrow, weak sections of filaments, which tend to be hotter, receive more tungsten. This "self-healing" reaction, now in widespread use in macroscopic halogen light bulbs, extends the life of the filament tremendously and allows for higher useful operating temperatures and greater efficiency. This invention includes the combination of microfabricated incandescent technology and halogen technology.

Figure 6:
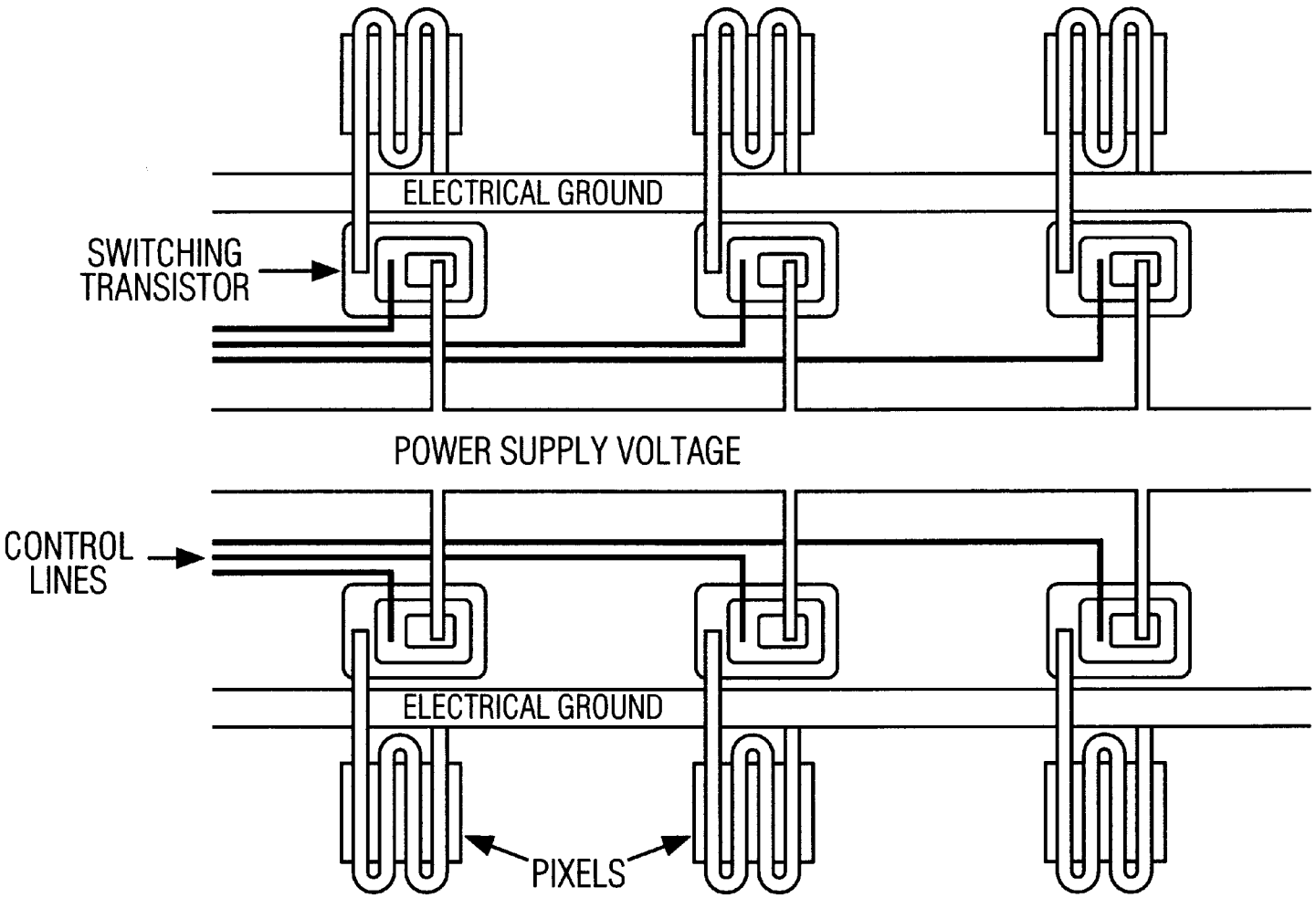
FIG. 6 is a diagram of an array of filaments with one switch per element, in accordance with one aspect of the invention.

The lamp elements formed in accordance with FIGS. 1 and 2 to form the flat panel assemblies shown in FIGS. 4 and 5 may be formed with a control transistor per lamp element, as shown in FIG. 6. The use of one transistor per element allows for the independent control of each and every lamp in the flat panel assembly. However, this requires a large number of transistors and control lines. The materials and processes used to form the control transistors are compatible with the materials and processes used to fabricate the lamp elements. The transistors used to address the individual pixels may be produced directly on the substrate, if the substrate is made from silicon, or with thin-film silicon on a different insulating substrate material. In order to provide for a visually appealing display, without large, visible, dark areas, the surface area occupied by the individual transistors may be made comparable to or smaller than that of the lamps. For the same reason, the space required for the control lines may be comparable to, or less than, that required for the size lamps, whose range of sizes are described above.

In FIG. 6, (M×N) transistors and (M×N) control lines are needed to control an array of (M×N) filaments arranged in M rows and N columns. Such a scheme may be impractical in building large arrays. For the fabrication of large arrays, an arrangement such as shown in FIG. 7 may be preferred, where (M+N) transistors and (M+N) control lines are needed to control (M×N) filaments arranged in M rows and N columns; where M and N are integers which may range from 1 to several thousands.

Figure 7:
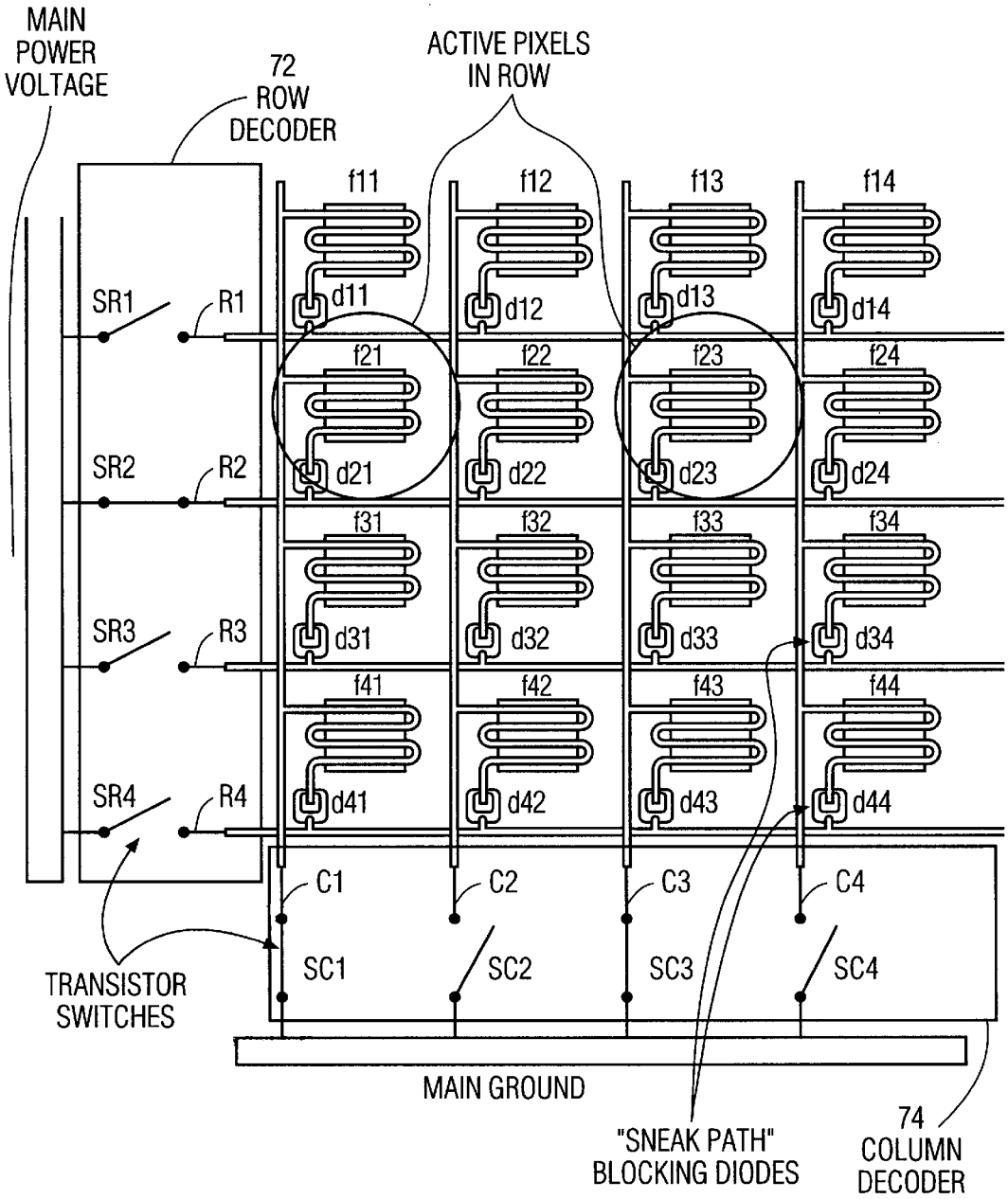
FIG. 7 is a top view of an array of filaments in accordance with the invention, with the array having one switch per row and one switch per column.

In FIG. 7, there is shown, by way of example, an array of 4 rows and 4 columns with a row conductor ($R_i$) per row and a column conductor ($C_j$) per column with a lamp (or pixel) element $L_{ij}$ connected between a row $R_i$ and a column $C_j$. Each lamp element $L_{ij}$ includes a filament ($f_{ij}$) and a diode ($d_{ij}$) connected in series. In the absence of the diodes $d_{ij}$, there would exist sneak conduction paths due to the purely resistive nature of the filaments. The diodes ($d_{ij}$) are provided to block or eliminate "sneak paths" and thereby prevent currents from flowing in and through unselected lamp elements. These diodes can be relatively crude and can be manufactured using elementary semiconductor processing techniques. The row conductors ($R_i$) are shown connected to a row decoder 72 and the column conductors ($C_j$) are shown connected to a column decoder 74; where decoders 72 and 74 may be any one of a number of known decoders whose operations are known and need not be detailed. For ease of illustration, each row conductor Ri is shown connected via an associated switch SRi to the row decoder and each column conductor Cj is shown connected via an associated switch SCj to the column decoder.

The row decoders function to apply a first predetermined voltage to a selected row and the column decoders function to apply a second predetermined voltage to selected columns. For the arrangement shown in FIG. 7, the display panel would be operated (energized) one row at a time by the application of a voltage of, for example, positive 5 volts to a selected row $R_i$ via a corresponding transistor switch $SR_i$. With an energizing voltage applied to a row conductor $R_i$, one or more of the lamp elements $L_{ij}$ along the selected row $R_i$ would be lit-up (or turned-on) by the selected closure of corresponding column switches $SC_j$. For example, in FIG. 7, if $SR_2$ is closed, 5 volts are applied to Row $R_2$. If switches SC1 and SC3 are closed, columns $C_1$ and $C_3$ are grounded and current will flow through lamps L21 and L23. That is, a current will flow from row conductor $R_2$ through diode $d_{21}$ and filament f21 to column conductor C1 and thence to ground. Concurrently, a current will also flow from row conductor R2 through diode d23 and filament f23 to column conductor C3 and thence to ground. This scheme allows one or more (or none) of the lamp elements of a row to be turned-on at the same time. [Note that the rows and columns can be interchanged and the display may alternatively be lit in a column by column fashion.]

Figure 8:
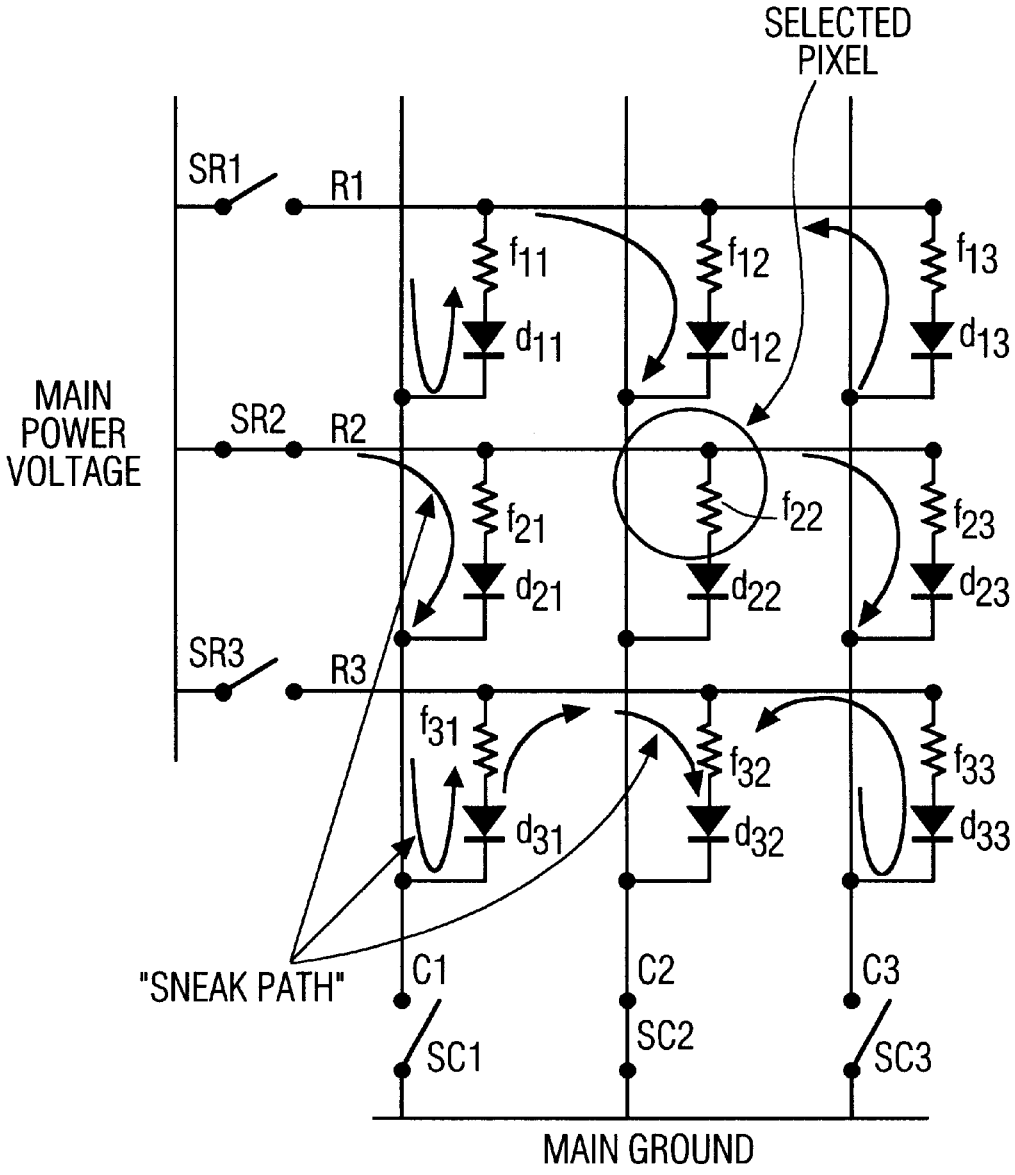
FIG. 8 is a schematic diagram representation of the array of FIG. 7.

FIG. 8 is presented to better explain the role of the diodes in blocking the sneak paths. Note that each filament may be characterized as a resistive element. Assume that power is applied to row $R_2$ and that switch $SC_2$ is closed to cause current to flow through filament $f_{22}$. In the absence of the diodes, current would flow through multiple sneak paths. For example, current would flow from conductor $R_2$ via filaments $f_{21}$, $f_{31}$ and $f_{32}$ to the ground applied on column $C_2$. Under some circumstances, these sneak path currents may be of sufficiently low amplitude, due to the fact that the "sneak path" lamps are all in series, to be tolerated. However, where the diodes can be manufactured without occupying much space and at a very low cost, their inclusion is preferred.

Figure 9:
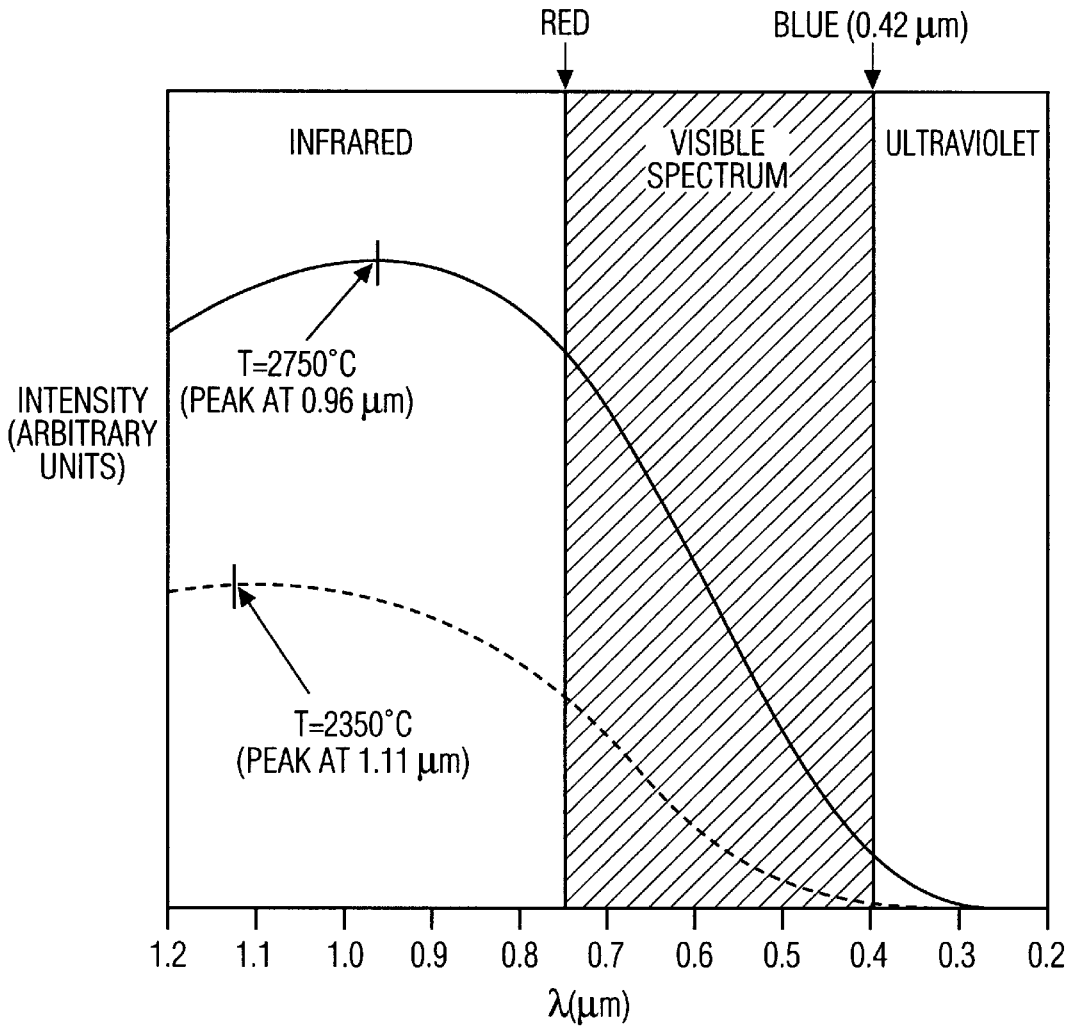
FIG. 9 is a diagram of the light intensity output as a function of the wavelength at two different filament temperatures.

The ultimate efficiency and color performance of any optical incandescent device is determined by the maximum temperature at which the filament can be operated without failure. This is because incandescent lamps operate at a temperature at which much of the light being emitted is at infrared wavelengths. The observer sees the light of an intensity curve which peaks at a color beyond the ability of the eye to see. This is illustrated in FIG. 9 which is a graph of intensity versus wavelength for an ideal black body at two different temperatures. Since the intensity curve has a downward slope toward shorter wavelengths, there is always somewhat more red light than blue. Running the lamp filament at a hotter temperature moves the peak of this curve closer to the visible range and, therefore, wastes less of the power. Using the graph of FIG. 9, a filament running at 2750° C. is almost twice as efficient (1.92 times) as one running at 2350° C. In addition, a higher-temperature filament gives a higher percentage of blue light, as can be seen in the figure. The addition of a gas within a sealed enclosure containing the lamp assembly, permits operation of the lamp filaments at higher temperatures and at greater efficiencies.

Figure 10A:
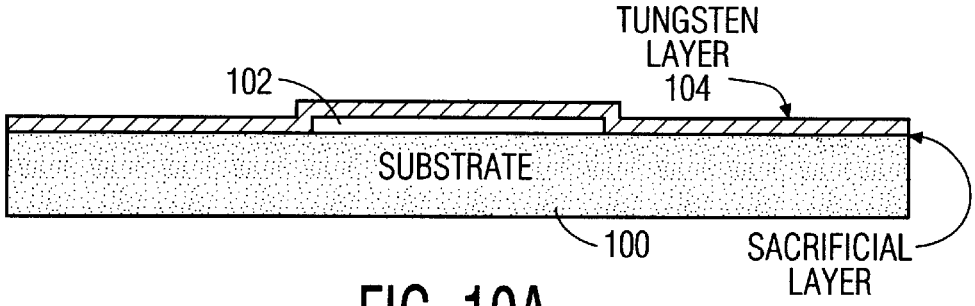
FIGS. 10A–10F are cross-section diagrams of an incandescent lamp formed in its own envelope in accordance with the invention.
Figure 10B:
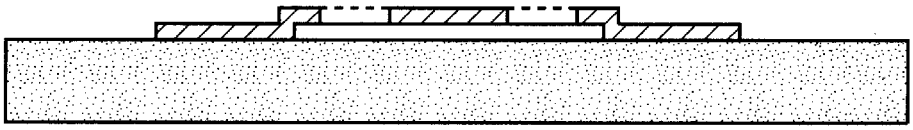
Figure 10C:
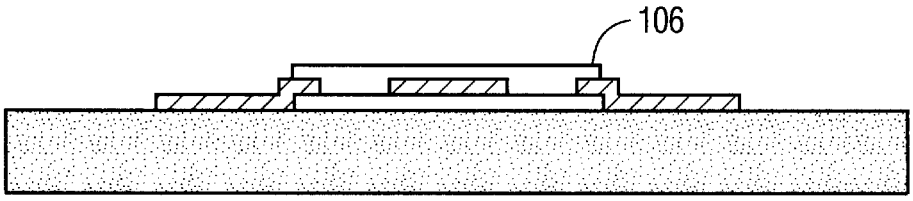
Figure 10D:
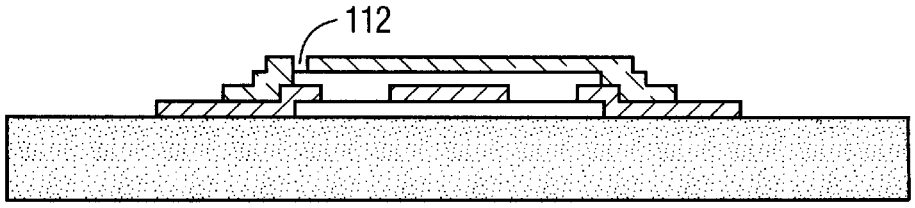
Figure 10E:
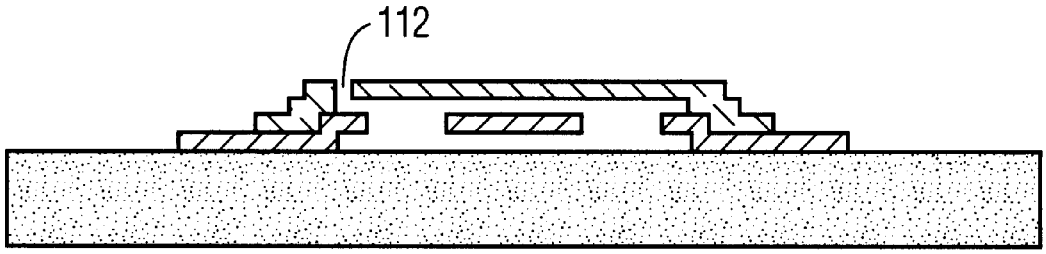
Figure 10F:
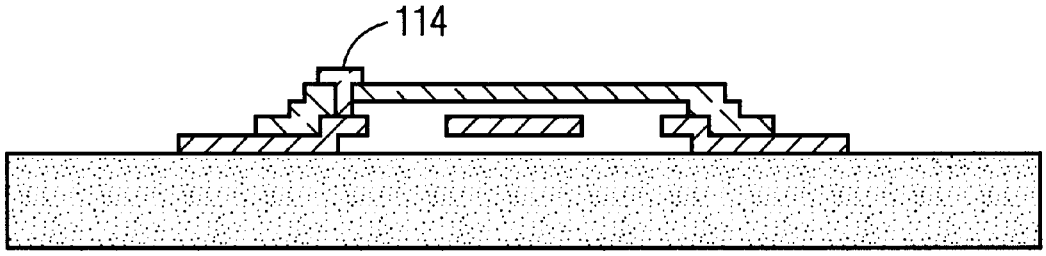

A flat panel assembly may also be formed using an individually gas filled, sealed pocket for each lamp, as shown in FIGS. 10A through 10F. A cavity to enclose a single filament (or several filaments) may be produced by depositing two sacrificial layers of an easily dissolved material, such as, but not limited to, glass or plastic. FIG. 10A shows a first sacrificial layer 102 deposited on a substrate 100 and a tungsten layer 104 deposited on the sacrificial layer 102. The tungsten layer is then patterned to form a filament with a desired shape as shown in FIG. 10B. A second sacrificial layer 106 is then deposited on the tungsten layer, after the patterning of the tungsten has been completed, as shown in FIG. 10C. A capping layer of a more inert material such as, but not limited to, sapphire, is deposited over all of the other layers, as shown in FIG. 10D. The capping layer seals the chamber (pocket) below, while letting light through during operation of the filament or filaments enclosed within the particular chamber. As shown in FIGS. 10D and 10E, openings, or micromachined port holes 112 are etched around the edge of the capping layer to expose the sacrificial layers. The entire substrate is immersed in an etchant which dissolves the sacrificial material but does not react with the other materials, to form an unsealed cavity or chamber. Then, as shown in FIG. 10F, the chamber may be filled with a gas and then the cavity may be sealed by depositing a sealing layer 114 that plugs the port holes around the edge of the cap. The sealing may be done in a vacuum, or in an atmosphere of a gas, such as a halogen or an inert gas, for prolonging the filament lifetime and allowing higher operating temperatures, as discussed above. The result is a sealed pocket containing a vacuum or a gas, depending on the design requirements. The sealing layer may be etched away except for the plug area 114. Alternatively, if the sealing layer is clear, it can be left covering the entire substrate except where electrical connections must be made.

Figure 11A:
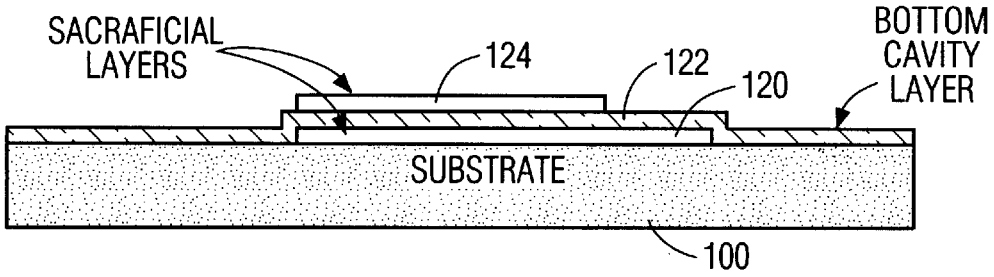
FIGS. 11A–11H are cross-section diagrams of still another incandescent lamp formed in accordance with the invention.
Figure 11B:
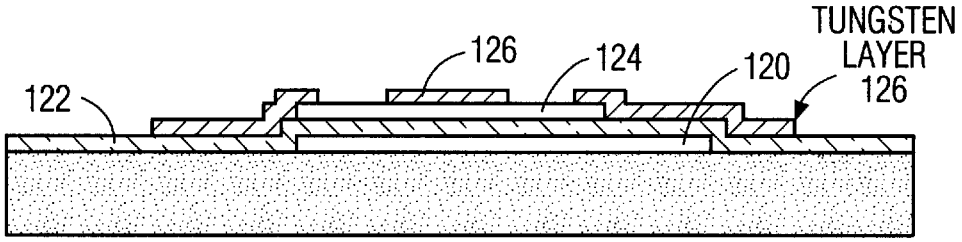
Figure 11C:
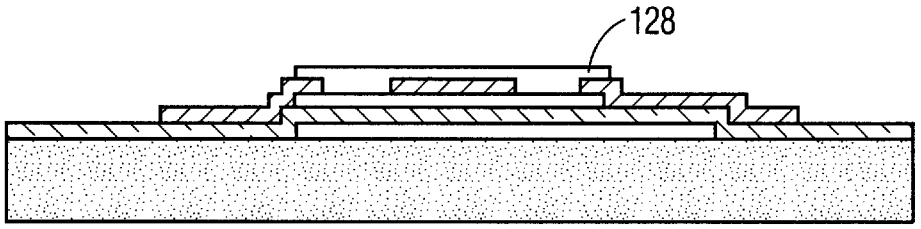
Figure 11D:
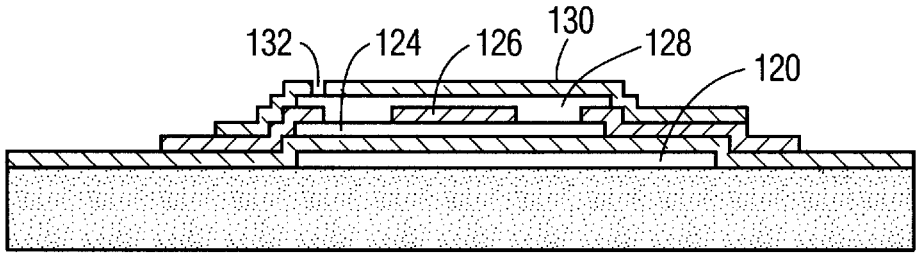
Figure 11E:
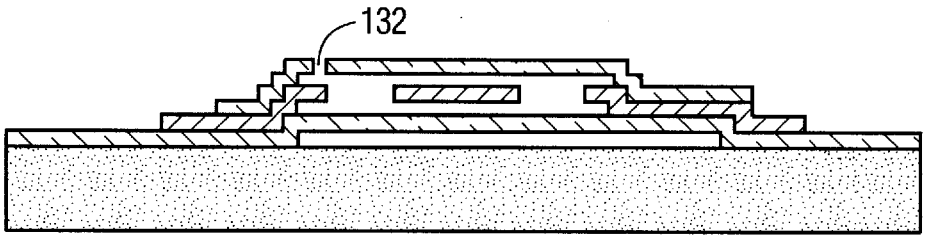
Figure 11F:
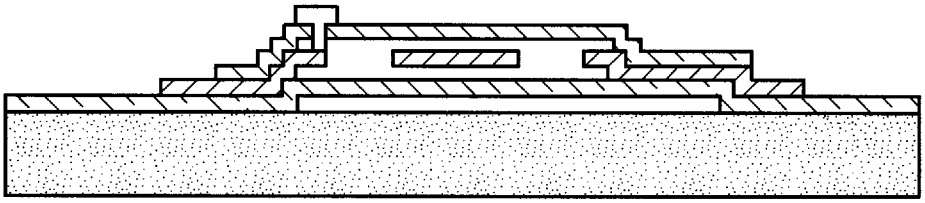
Figure 11G:
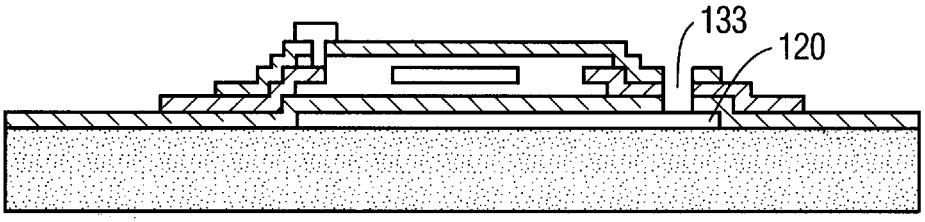
Figure 11H:
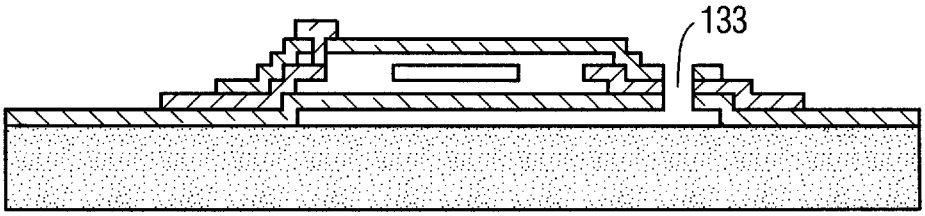

In some cases, where a halogen compound is sealed in the individual pockets, or where a tungsten halide compound is generated during operation, the compound may be a liquid or a solid at room temperature. For these conditions, it would require that the operating temperature of the walls of the pocket be elevated to insure that the compound does not condense and accumulate on the walls of the pocket. This may be accomplished by using an extra sacrificial layer and an extra inert layer, as illustrated in FIGS. 11A through 11H. FIG. 11A shows a first sacrificial layer 120 deposited on a substrate 100. Then, a bottom cavity layer 122, of a relatively inert material, similar to the capping material, is deposited over the first sacrificial layer 120 and substrate 100. Then, a second sacrificial layer 124 is deposited over cavity layer 122. A tungsten layer 126 is then deposited over sacrificial layer 124 and bottom cavity layer 122 and the tungsten layer 126 is then patterned as shown in FIG. 11B. Then, a third sacrificial later 128 is deposited on the tungsten layer 126 and the second sacrificial layer 124, and the third sacrificial layer is patterned, as shown in FIG. 11C. Then, a top capping layer 130 of a relatively inert material is deposited on the third sacrificial layer 128, as shown in FIG. 11D. Then, as shown in FIGS. 11D and 11E, port holes 132 are opened through the capping layer 130 all the way down to the third sacrificial layer 128, after which both the second and third sacrificial layers 124 and 128 are etched away, forming the filament pocket. Then the substrate is placed in an inert or reactive gas environment and a plug layer is deposited to close port holes 132 and seal in the gas as shown in FIG. 11F. Then, as shown in FIG. 11G, a second group of port holes 133 are opened all the way down to the first sacrificial layer 120, which is then etched away leaving an empty cavity beneath the filament pocket. When the display is in use, the entire substrate is operated within a sealed chamber of vacuum or low-pressure gas, allowing the capping layer 130 to reach an elevated temperature high enough so that the gas within the pocket does not solidify upon it. The elevated temperature is reached due to radiative and conductive heat absorbed from the filament. Also, since there is now an unsealed, secondary cavity beneath the bottom layer of the filament cavity, this bottom layer also reaches the desired temperature.

Note that individually sealed pockets may not be necessary if the entire assembly illustrated in FIG. 5 has a resistive heater attached to it and is enclosed in a secondary, vacuum assembly. Where the chamber is filled with a gas such as halogen, the temperature of the entire halogen chamber is raised above the evaporating point of the halogen compound, or the resulting tungsten halide compound. This prevents the compounds from condensing anywhere inside the inner chamber.

Figure 12:
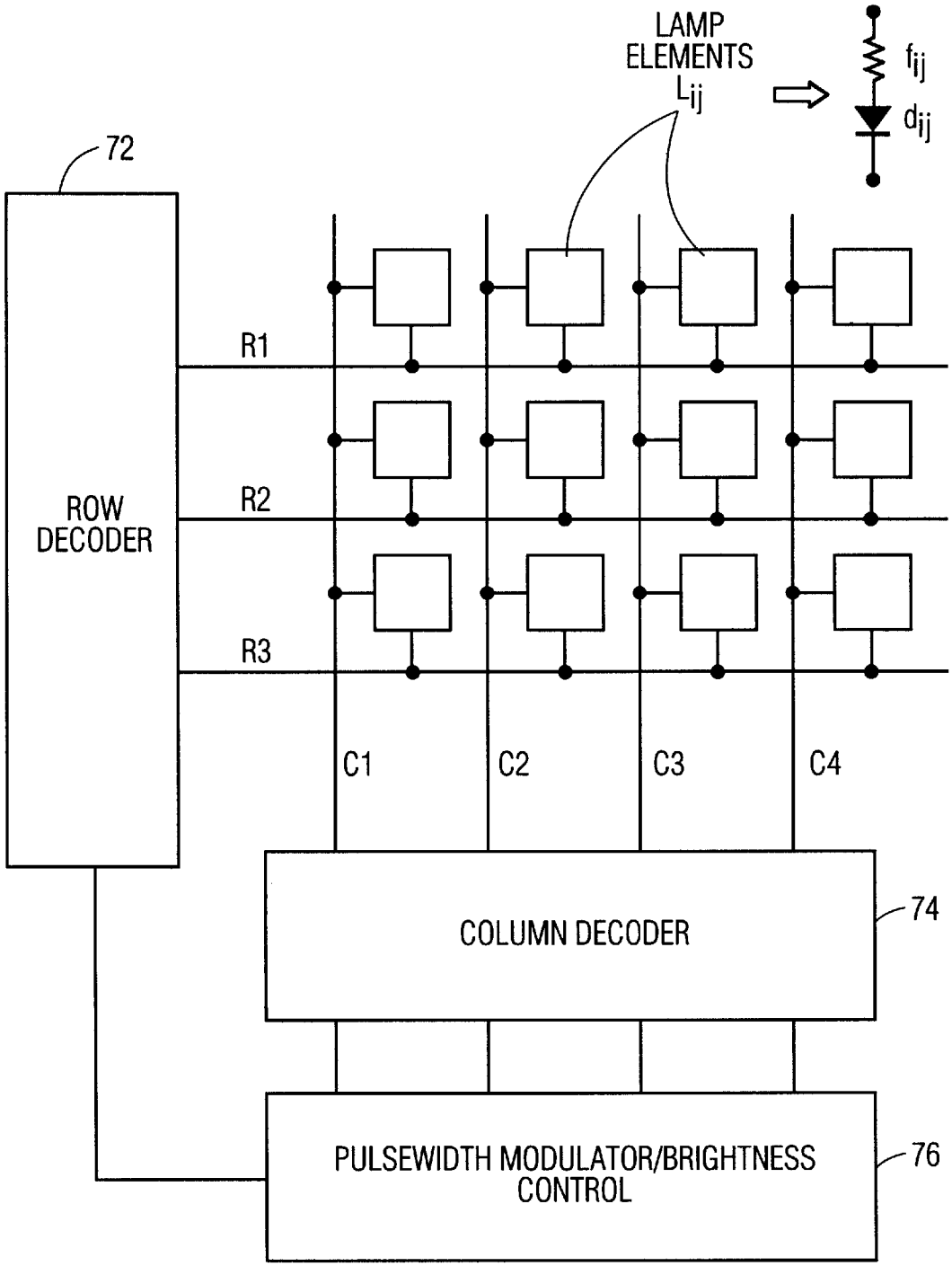
FIG. 12 is a block diagram of a lamp assembly system designed to be operated in a pulse width modulated manner in accordance with the invention.

FIG. 12 shows an array of 3 rows and 4 columns of incandescent lamps manufactured in accordance with the invention. Each of the lamps $L_{ij}$ may include a filament $f_{ij}$ connected in series with a diode $d_{ij}$, the series combination of a filament $f_{ij}$ and diode $d_{ij}$ being connected between a row conductor $R_i$ and a column conductor $C_j$.

The row conductors $R_i$ are connected to a row decoder 72 and the column conductors $C_j$ are connected to a column decoder 74. The row decoder 72 enables the selection of one complete row of elements at time and to apply an enabling first voltage (e.g., +5 volts) to the corresponding row conductor. The column decoder enables the selection of one or more columns at a time. Typically, (with a positive voltage applied to the row) the column conductor corresponding to a selected lamp would be placed at a second voltage (e.g., ground) to cause conduction through the selected lamp.

Figure 13:
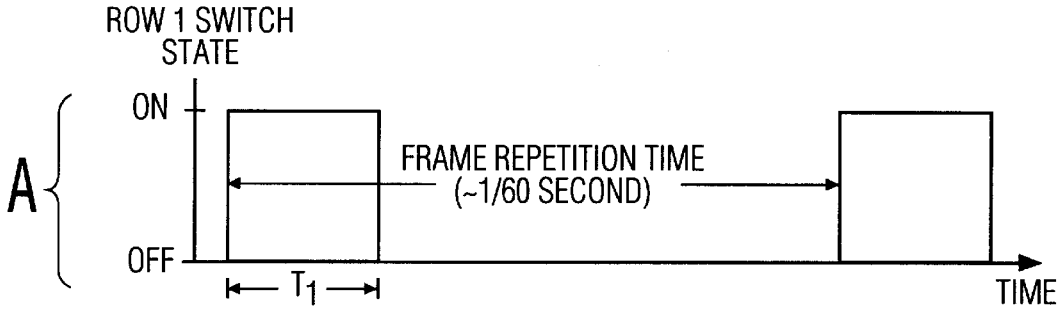
FIG. 13 are waveforms illustrative of pulse width modulated signals which may be applied to the system of FIG. 12.
Figure 13:
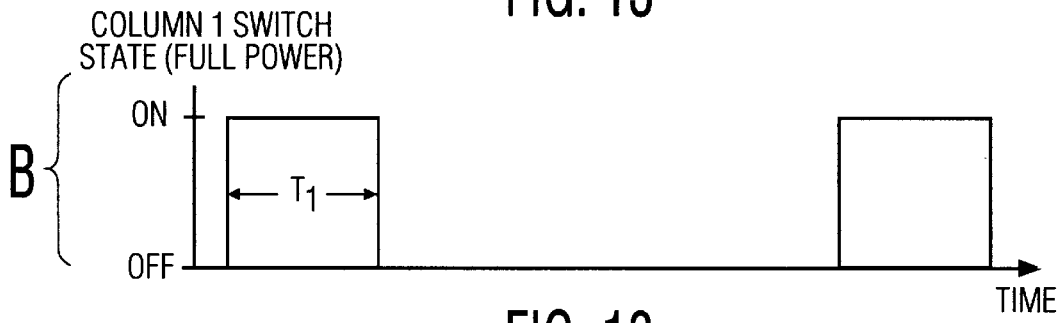
Figure 13:
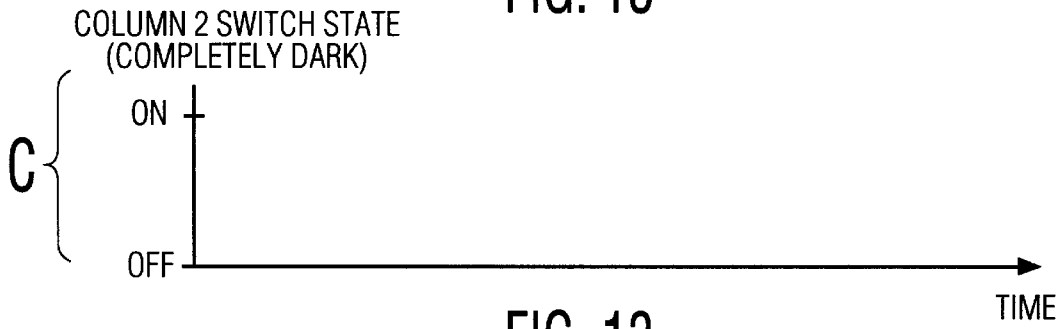
Figure 13:
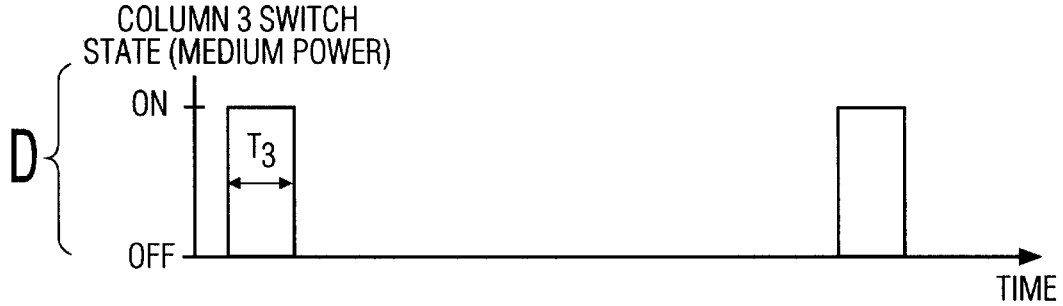

The circuit of FIG. 12 includes a pulse width modulator 76 which is used to control the brightness of selected lamps. In systems according to the invention, the brightness of selected lamps is preferably controlled by applying the same full voltage (e.g., 5 volts) across each lamp selected to be energized, but then varying the length of time the full voltage is applied across the lamps. Thus, as shown in FIG. 13, each selected row would be turned on for a time T1, as shown in waveform A of FIG. 13. The column switch for a selected column may be enabled for a period of time ranging from zero to T1. In waveform B of FIG. 1, the column switch is turned on during the full period T1 that the row is energized. In waveform C of FIG. 13, the column switch is not turned on at all. In waveform D of FIG. 13, the column switch is enabled for a time T3 which may be any time duration ranging between zero and T1.

Figure 14:
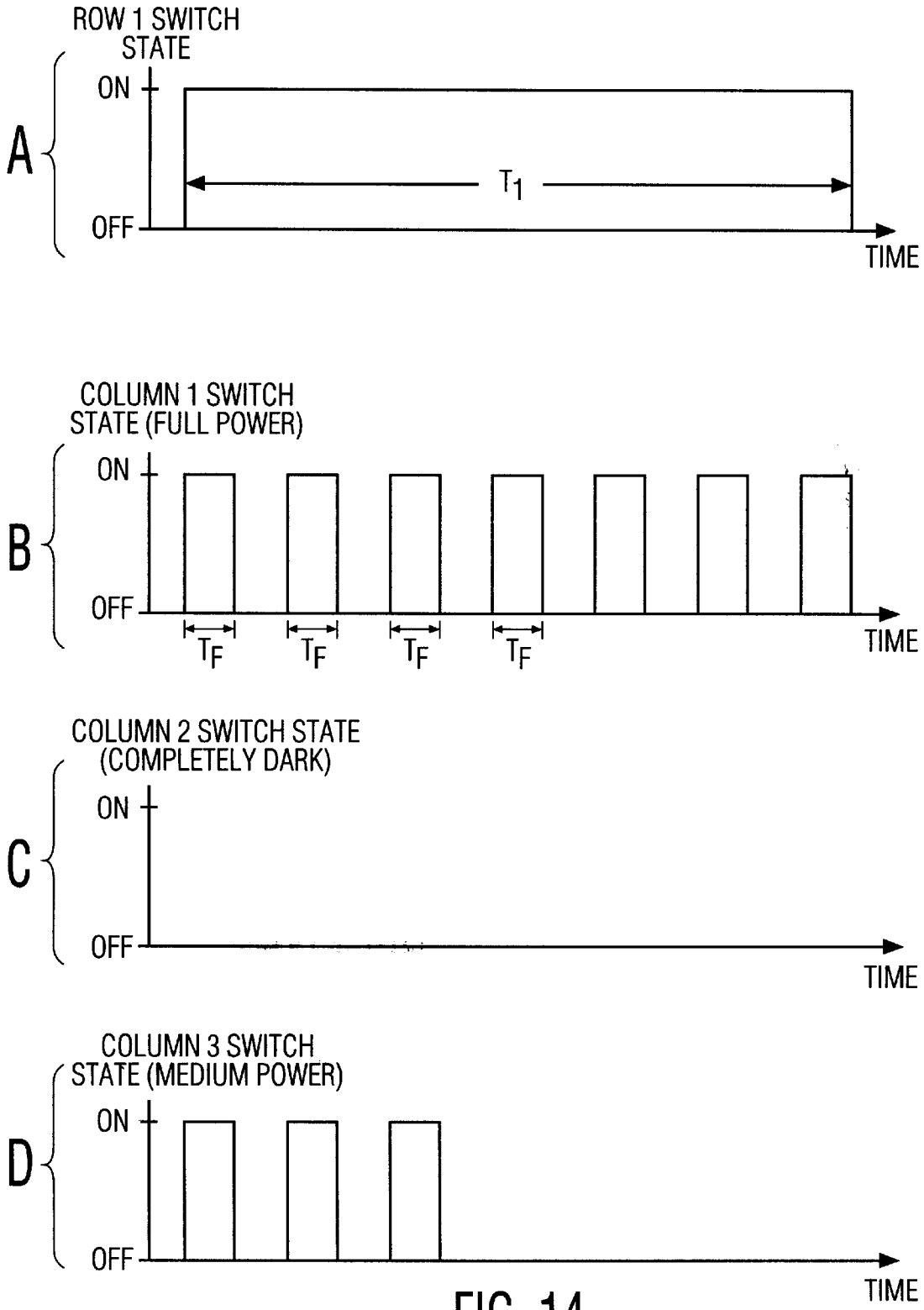
FIG. 14 are waveforms illustrative of another type of pulse width modulated signals which may be applied to the system of FIG. 12.

Alternatively, as shown in FIG. 14, pulses having a fixed pulse width and a fixed amplitude may be applied across the selected lamps; where the pulse width of these pulses is a small fraction (e.g., 1/10) of the time period (e.g., T1) for which the row is energized. The number of pulses applied to a lamp during any fixed time interval are varied and programmed to control the effective brightness of that lamp. Thus, waveform A of FIG. 14 shows that a row switch would be enabled for a time period T1. Waveform B shows that for full power or brightness, 7 pulses would be applied to the filament during T1. Waveform C shows that to keep the lamp dark, no pulses would be applied to a filament during T1. In waveform D, 3 pulses are applied to a lamp during period T1 to produce "medium" brightness. However, it should be evident that any number of preselected pulses may be selectively applied to a selected filament during a given time period to provide a wide range of brightness control. An advantage of operating the lamps at a fixed voltage and fixed power but for different time periods is that the quality of the light output will be more constant, the only difference being the perceived brightness.

Figure 15:
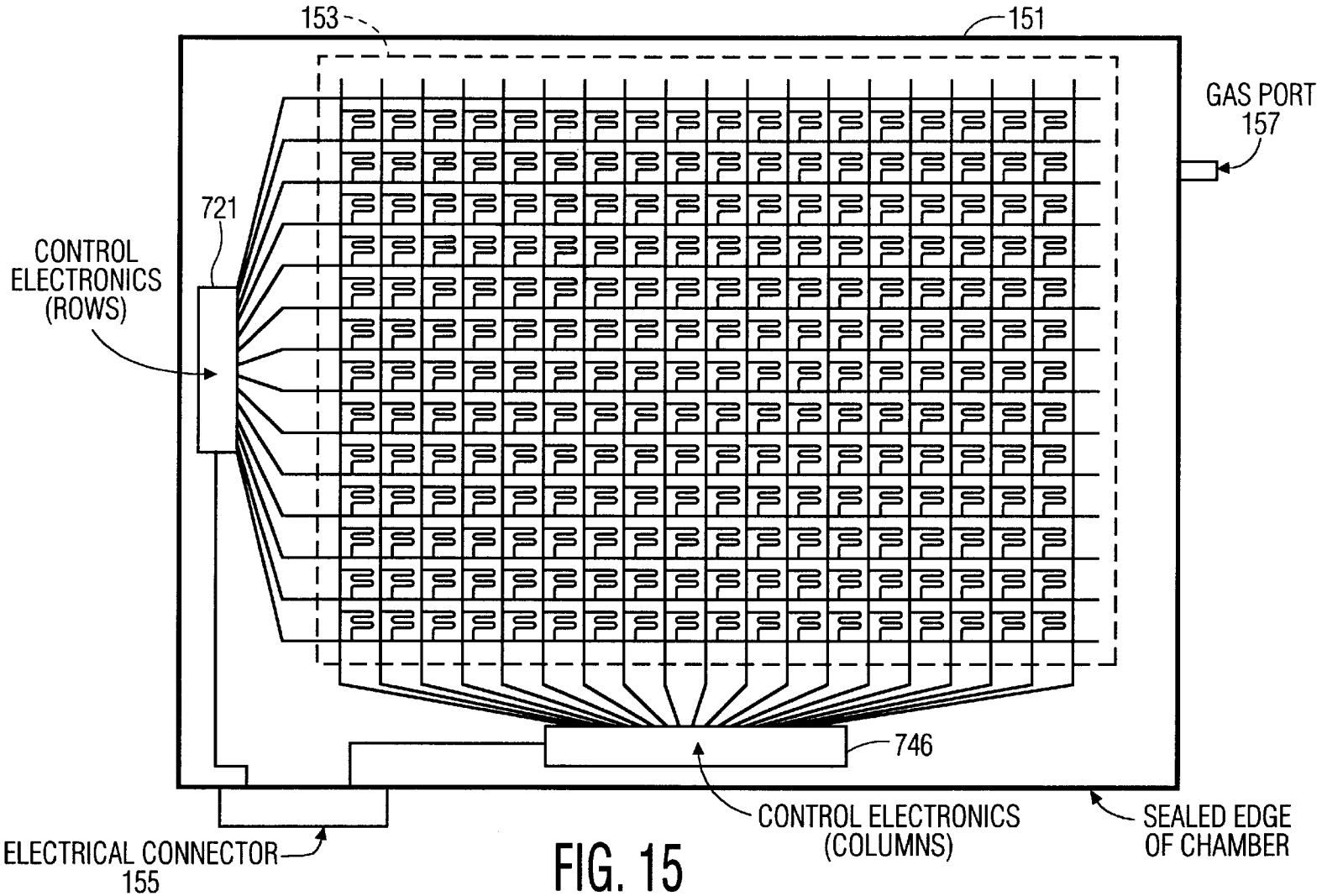
FIG. 15 is a front view of a flat panel assembly embodying the invention.

The front view of a flat panel display assembly embodying the invention may be as shown in FIG. 15. A sealed enclosure 151 encloses an array 153 of lamps $L_{ij}$ with control electronics 721 for the rows and control electronics 746 for the columns. An electrical connector 155 enables access to the assembly while a gas port 157 enables the enclosure 151 to be filled with gas after which the port 157 is sealed, as discussed above. Also, as discussed above, the lamp array may be energized one row at a time with each lamp along a selected row being energizable for a different time period for controlling the brightness of the lamps along the row in a controllable well determined manner. FIG. 15 illustrates that the circuitry to supply power to selected incandescent lamps and to control their turn-on and turn-off may be located along the edges of a panel containing an array of incandescent lamps and may be arranged to activate one row (or column) of incandescent lamps at a time, with only selected lamps being energized.

Finally, the advantage of using microminiature incandescent lamps over other known devices to form flat panel displays is summarized in Table I, appended hereto. In particular, it may be observed that the microminiature incandescent lamps are better than LCD's in terms of efficiency, speed and viewing angle It may also be observed that they outperform the other technologies in terms of the efficiency of full color displays.

TABLE I

Performance of room-temperature infrared detectors suitable for focal plane arrays.

| Parameter | FP-incandescent | Back-lit LCD | LED | EL | Plasma | CRT |
|---|---|---|---|---|---|---|
| Efficiency: | 7.9 lm/W | 2.3 lm/W | 0.23 lm/W | 0.19 lm/W | 0.7 lm/W | 0.5 lm/W |
| Color: | Full spectrum | Full spectrum | Blue expensive | Blue difficult | Full color | Full Color |
| Speed: | <30 ms(video) | ~50 ms | <30 ms | <30 ms | <30 ms | <30 ms |
| Viewing <: | ~180° | ~90° | ~180° | ~180° | ~180° | ~180° |

What is claimed is:

1. A flat panel display comprising:

A matrix array of micromachined incandescent lamp elements formed on a substrate for producing a source of light at each lamp element location, said lamp elements being arranged in rows and columns with a row conductor per row of lamp elements and a column conductor per column of lamp elements with the lamp elements of a column being connected at one end to the same column conductor and the lamp elements of a row being connected at another end to the same row conductor and with each lamp element being connected between a different row and column conductor;

a first panel of transparent material;

enclosure means for mounting said first panel in front of said substrate and spaced therefrom; said substrate being mounted within said enclosure whereby said lamps can project light through said front panel; and means for injecting a gas into said enclosure and sealing the enclosure for maintaining said gas between said front panel and said substrate.

2. A flat panel display assembly as claimed in claim 1, wherein the gas is an inert gas.

3. A flat panel display assembly as claimed in claim 2, wherein the inert gas is argon.

4. A flat panel display assembly as claimed in claim 1, wherein the gas is a halogen gas.

5. A flat panel display assembly as claimed in claim 1, wherein the gas is a compound of halogen.

6. A flat panel display assembly as claimed in claim 1, wherein the enclosure means includes a back plane located behind and spaced from the substrate; and wherein the gas injected in the enclosure means is also contained between the substrate and the back plane.

7. A flat panel display assembly as claimed in claim 1, wherein each one of said micromachined incandescent lamp elements includes a filament formed by:

(a) depositing a layer of silicon nitride upon said substrate, and a tungsten layer upon the silicon nitride layer;

(b) back etching the substrate material to expose portions of the silicon nitride layer;

(c) patterning the silicon nitride layer and the tungsten layer to shape the filament; and (d) removing the silicon nitride layer leaving a shaped filament consisting of a tungsten layer.

8. A flat panel display assembly as claimed in claim 7, wherein each filament has first and second ends for the application therebetween of an operating voltage to cause current to flow through the filament and emit a light so as to function as a light source.

9. A flat panel display assembly as claimed in claim 8, wherein a diode is fabricated in series with each filament, such that said diode can block current from spuriously passing through said each filament during illumination of a different filament.

10. A flat panel display assembly as claimed in claim 9, wherein the filament is formed having a serpentine shape to provide increased resistance for a given space.

11. A flat panel display as claimed in claim 7 wherein the back etching of the substrate material extends for the full thickness of the substrate for enabling the lamp filament, when energized, to be seen from either side of the substrate.

12. A flat panel display assembly as claimed in claim 1, wherein each one of said micromachined incandescent lamp elements includes a filament formed by:

(a) depositing a layer of silicon nitride upon said substrate and a tungsten layer upon the silicon nitride layer;

(b) patterning the tungsten and silicon nitride layer to form regions having a desired shape;

(c) undercutting the substrate surface on which the silicon nitride layer is deposited leaving the shaped tungsten and silicon nitride layers; and (d) removing the silicon nitride layer and leaving an exposed tungsten filament overlying an undercut substrate region.

13. A flat panel display assembly as claimed in claim 12, wherein each filament has first and second ends for the application therebetween of an operating voltage to selectively cause current to flow through the filament and emit light so as to function as a light source.

14. A flat panel display assembly as claimed in claim 13, wherein a diode is fabricated in series with each filament, such that said diode can block current from spuriously passing through said each filament during illumination of a different filament.

15. A flat panel display assembly as claimed in claim 14, wherein the filament of each one of said micromachined incandescent lamps has a serpentine shape to provide increased resistance for a given space.

16. A flat panel display assembly as claimed in claim 1, wherein each one of said lamp elements includes a filament in series with a diode, such that said diode can block current from spuriously passing through said each one of said lamp elements during illumination of a different lamp element.

17. A flat panel display assembly as claimed in claim 1, wherein said substrate is of silicon.

18. A flat panel display assembly as claimed in claim 1, wherein different color filters are disposed on said first, front, panel.

19. A flat panel display assembly as claimed in claim 1, wherein each one of said micromachined incandescent lamp elements includes a filament formed by:

(a) depositing a tungsten layer upon said substrate;

(b) back etching the substrate material to expose portions of the tungsten layer; and (c) patterning the tungsten layer to shape the filament.

20. A flat panel display assembly as claimed in claim 1, wherein each one of said micromachined incandescent lamp elements includes a filament formed by:

(a) depositing a tungsten layer upon said substrate;

(b) patterning the tungsten layer to form regions having a desired shape; and (c) undercutting the substrate surface over which the tungsten layer is patterned leaving an exposed tungsten filament overlying an undercut substrate region.

21. A flat panel display assembly as claimed in claim 1 wherein said substrate is of glass.

22. A flat panel display as claimed in claim 1 wherein the row and column conductor are all formed, and extend, on the same side of the substrate as the lamp filaments.

23. A flat panel display assembly comprising:

a sealable enclosure means having a top end and a bottom end;

a front panel of transparent material located at the top end of said enclosure means;

a matrix array of micromachined incandescent lamp elements formed on a substrate for selectively producing a spot of light at each lamp element location;

means mounting said substrate within said sealable enclosure means, spaced from and located behind, said front panel;

a back panel located at the bottom end of said sealable enclosure means, spaced from and located behind said substrate; and a gas contained within said sealable enclosure means between said front panel and said substrate and between said substrate and said back panel.

24. A flat panel display assembly comprising:

an array of light emitting sites arranged in rows and columns;

each light emitting site including a micromachined incandescent lamp in series with a diode for enabling current conduction in only one direction through its series connected lamp;

a row conductor per row of light emitting sites and a column conductor per column of light emitting sites; a light emitting site being formed at the intersection of each row and column conductor;

decoder means coupled to the row conductors for applying a first, enabling, voltage to one row conductor at a time;

means coupled to the column conductors for applying a second voltage to selected column conductors for selectively turning-on the lamps connected between the selected column conductors and the row conductor to which a first enabling voltage is applied; and wherein said micromachined incandescent lamps are located in a sealed gas filled enclosure.

25. A flat panel display comprising:

a matrix array of micromachined incandescent lamp elements formed on a substrate, with the lamp elements being disposed in rows and columns; said matrix array being contained within a sealed gas filled envelope;

a row conductor per row of light emitting sites and a column conductor per column of light emitting sites; a light emitting site being formed at the intersection of each row and column conductor;

decoder means coupled to the row conductors for applying a first, enabling, voltage to one row conductor at a time; and means coupled to the column conductors for applying a second voltage to selected column conductors for selectively turning-on the lamps connected between selected column conductors and the row conductor to which a first enabling voltage is applied.

26. A flat panel display assembly comprising:

a matrix array of micromachined incandescent lamp elements formed on a substrate, with the lamp elements being disposed in rows and columns; each lamp element including a filament contained within a sealed gas filled envelope;

a row conductor per row of light emitting sites and a column conductor per column of light emitting sites; a light emitting site being formed at the intersection of each row and column conductor;

decoder means coupled to the row conductors for applying a first, enabling, voltage to one row conductor at a time;

means coupled to the column conductors for applying a second voltage to selected column conductors for selectively turning-on the lamps connected between selected column conductors and the row conductor to which a first enabling voltage is applied; and wherein each one of said lamp elements is formed by:

(a) forming a sacrificial layer on one surface of a substrate:

(b) depositing a layer of tungsten over the sacrificial layer;

(c) patterning the tungsten layer to form and shape the filaments;

(d) depositing and patterning a second sacrificial layer over the tungsten layer forming a filament;

(e) depositing a clear capping layer over the second sacrificial layer and patterning the capping layer to include port holes;

(f) etching the sacrificial layers to form a pocket around the filament; and (g) filling the pocket with gas and sealing the pocket.

27. A flat panel display assembly comprising:

a matrix array of micromachined incandescent lamp elements formed on a substrate, with the lamp elements being disposed in rows and columns; each lamp element including a filament contained within a sealed gas filled envelope;

a row conductor per row of light emitting sites and a column conductor per column of light emitting sites; a light emitting site being formed at the intersection of each row and column conductor;

decoder means coupled to the row conductors for applying a first, enabling, voltage to one row conductor at a time;

means coupled to the column conductors for applying a second voltage to selected column conductors for selectively turning-on the lamps connected between selected column conductors and the row conductor to which a first enabling voltage is applied; and wherein each one of said lamp elements is formed by:

(a) forming a first sacrificial layer on one surface of the substrate, a bottom cavity layer on top of the first sacrificial layer, and a second sacrificial layer on top of the bottom cavity layer;

(b) depositing a layer of tungsten on the second sacrificial layer and patterning the tungsten to form a filament of desired shape;

(c) depositing a third sacrificial layer over the tungsten filament and patterning the third sacrificial layer;

(d) depositing a clear capping layer over the third sacrificial layer and patterning a port hole;

(e) etching the second and third sacrificial layers to form a cavity pocket surrounding the tungsten filament;

(f) filling the cavity pocket with a gas and sealing the filament cavity pocket;

(g) patterning another port hole all the way to the first sacrificial layer; and (h) etching the first sacrificial layer to suspend the sealed filament cavity pocket.

28. A flat panel display assembly comprising:

an array of light emitting sites arranged in rows and columns, with each light emitting site including a micromachined incandescent lamp; said array of light emitting sites being formed within a sealed gas enclosure;

a row conductor per row of light emitting sites and a column conductor per column of light emitting sites; a light emitting site being formed at the intersection of each row and column conductor;

decoder means coupled to the row conductors for applying a first, enabling, voltage to one row conductor at a time; and means coupled to the column conductors for applying a second voltage to selected column conductors for applying the same voltage across each lamp selected to be energized and for selectively applying this same voltage for different lengths of time for controlling the brightness of the lamps.

29. A flat panel display assembly as claimed in claim 28, wherein each lamp site includes a filament in series with a diode.

* * * * *